US006817496B2

(12) United States Patent
Damrath et al.

(10) Patent No.: US 6,817,496 B2
(45) Date of Patent: Nov. 16, 2004

(54) APPARATUS FOR PRESSING SHIRTS HAVING A PARTLY FLAT INFLATABLE BODY

(75) Inventors: Joachim Damrath, Bachhagel (DE); Sebastian Siegele, Berlin (DE); Markus Spielmannleitner, Ellwangen (DE); Gerhard Wetzl, Sontheim (DE)

(73) Assignee: BSH Bosch und Siemens Hausgerate GmbH, Munich (DE)

( * ) Notice: Subject to any disclaimer, the term of this patent is extended or adjusted under 35 U.S.C. 154(b) by 0 days.

(21) Appl. No.: 10/600,962

(22) Filed: Jun. 20, 2003

(65) Prior Publication Data

US 2004/0011834 A1 Jan. 22, 2004

Related U.S. Application Data

(63) Continuation of application No. PCT/EP01/14115, filed on Dec. 3, 2001.

(30) Foreign Application Priority Data

Dec. 20, 2000 (DE) ..... 100 63 668

(51) Int. Cl.[7] ..... A41H 5/02
(52) U.S. Cl. ..... 223/67
(58) Field of Search ..... 223/67, 66, 72, 223/73, 74; 34/442, 439, 440; 440/226

(56) References Cited

U.S. PATENT DOCUMENTS

| | | | | | |
|---|---|---|---|---|---|
| 561,371 | A | * | 6/1896 | Brigham | 223/67 |
| 2,985,344 | A | * | 5/1961 | Quaintance | 223/67 |
| 3,066,839 | A | | 12/1962 | Dosal | |
| 3,396,881 | A | | 8/1968 | Aloi | |
| 3,429,489 | A | | 2/1969 | Blevens | |
| 3,478,941 | A | * | 11/1969 | Dayton et al. | 223/67 |

FOREIGN PATENT DOCUMENTS

| | | |
|---|---|---|
| DE | 32 05 234 A1 | 8/1983 |
| JP | 61-209697 | 9/1986 |

* cited by examiner

*Primary Examiner*—John J. Calvert
*Assistant Examiner*—James G Smith
(74) *Attorney, Agent, or Firm*—Laurence A. Greenberg; Werner H. Stemer; Gregory L. Mayback

(57) ABSTRACT

A pressing body carries out pressing of shirts on a shirt-shaped inflation body, advantageously, by tensioning the shirt in a flat configuration and includes tensioning measures fixed to flat sections of the envelope of the inflation body, which draw the flat sections inwards or prevent the sections from adopting a round form on inflation. The tensioning measures can be, for example, flexible tensioning strips, connecting opposite regions of the envelope together and, furthermore, can partition those regions in which a reduced airflow occurs as a result of the thermal insulation.

18 Claims, 2 Drawing Sheets

APPARATUS FOR PRESSING SHIRTS HAVING A PARTLY FLAT INFLATABLE BODY

CROSS-REFERENCE TO RELATED APPLICATION

This application is a continuation of copending International Application No. PCT/EP01/14115, filed Dec. 3, 2001, which designated the United States and was not published in English.

BACKGROUND OF THE INVENTION

Field of the Invention

The present invention relates to an apparatus for pressing shirts, having a shirt-form inflatable body with a flexible enclosure that, in the inflated state, has at least one substantially flat section.

A shirt-pressing apparatus is disclosed in U.S. Pat. No. 3,066,839 to Dosal. The shirt-pressing apparatus described in Dosal has a shirt-form carrying frame around which an elastic inflatable body is positioned. The trunk section of the carrying frame has, on the sides, longitudinal struts that tension the inflatable body in the outward direction in the inflated state and, thus, ensure that the trunk section of the inflatable body assumes the shape of a narrow oval. This design for achieving flattening of the inflatable body has, in particular, the following disadvantages. The width of the inflatable body is predetermined on account of the necessarily fixed configuration of the longitudinal struts of the carrying frame. As a result, shirts of different sizes cannot be fitted equally well onto the inflatable body. Furthermore, the prior art apparatus for pressing shirts, on account of these fixed longitudinal struts, disadvantageously requires a considerable amount of space even when the inflatable body is not inflated. In addition, in this apparatus, the material of the inflatable body is subjected to considerable tensile loading, the loading becoming more pronounced as the flatness of the inflatable body in the inflated state increases. It is, likewise, the case that it is not possible for the front and rear sides of the inflatable body to be flattened to different extents because the longitudinal tensioning in the circumferential direction is substantially constant over the circumference.

SUMMARY OF THE INVENTION

It is accordingly an object of the invention to provide an apparatus for pressing shirts, having a partly flat inflatable body that overcomes the hereinafore-mentioned disadvantages of the heretofore-known devices of this general type and that improves the prior art apparatus to make possible a flattening of at least one section of the inflatable body even in the case of variable expansion of the inflatable body transversely to the flattening, the measures that are necessary for such a purpose are relatively cost-effective and the shirt-pressing apparatus does not require as much space when the inflatable body is not inflated.

With the foregoing and other objects in view, there is provided, in accordance with the invention, an apparatus for pressing shirts, including a shirt-form inflatable body having a flexible enclosure, the flexible enclosure having, in an inflated state of the body, at least one substantially flat section, pulling devices spaced apart from one another and fastened to the flat section at sections within the inflatable body, the pulling devices each having an end, the pulling devices acting substantially perpendicularly on the flat section at which the pulling devices are fastened when the inflatable body is inflated, the sections of the inflatable-body enclosure at which the pulling devices are fastened being retained in a flat form by the pulling devices when the inflatable body is inflated, and a stiff structure disposed within the inflatable body and fastened to the end of the pulling devices.

With the objects of the invention in view, there is also provided an apparatus for pressing shirts, including a shirt-form inflatable body having a flexible enclosure, the flexible enclosure having, in an inflated state of the body, at least one substantially flat section, spaced-apart pulling means fastened to the flat section at sections within the inflatable body, the pulling means having an end, the pulling means acting substantially perpendicularly on the flat section at which the pulling means are fastened when the inflatable body is inflated, the sections of the inflatable-body enclosure at which the pulling means are fastened being retained in a flat form by the pulling means when the inflatable body is inflated, and a stiff structure disposed within the inflatable body and fastened to the end of the pulling means.

Fastened inside the enclosure of the inflatable body, on the sections that are to remain substantially flat even in the inflated state, are pulling devices that subject this section to an inwardly directed force and/or prevent this location of the enclosure of the inflatable body from being forced outward by the internal inflating pressure. This makes it possible to prevent the inflatable-body enclosure from inflating into a round cross-section, and a flat cross-section can be achieved wherever desired. This is advantageous, in particular, in the trunk region of the inflatable body because, as a result of a flat inflatable-body trunk, the shirt is tensioned substantially in the lateral direction and, as such, the shirt can be pressed in a substantially fold-free manner. This process, furthermore, can also be used for the sleeve sections if the sleeves, during pressing, are to be tensioned to give a flat form.

In this embodiment, in accordance with another feature of the invention, it may additionally be provided that the pulling devices are fastened on the structure by fastening devices that can be displaced transversely to the pulling direction. The pulling devices may, thus, follow a movement of the inflatable-body enclosure if the latter, for example, on account of the different forms of the shirts fitted thereon, is moved into different positions. The displaceable fastening devices may be, for example, rings sliding on a rod or abutments sliding in guides.

Those ends of the pulling devices that are located opposite the fastening locations on the inflatable-body enclosure may be fastened on a stiff structure disposed within the inflatable body. It is, thus, possible for nearly random sections of the inflatable-body enclosure to be retained in flat form in the inflated state. The structure located within the inflatable body, here, may be considerably smaller than the inflated inflatable body. As a result, the apparatus only takes up a small amount of space when the apparatus is not being used and the inflatable body has not been inflated.

In accordance with a further feature of the invention, it is also possible for, in each case, two ends of the pulling devices to be fastened on sections of the inflatable-body enclosure. As such, in particular, mutually opposite sections of the inflatable-body enclosure can be pulled together. As a result, the flattening can be achieved without a structure needing to be disposed within the inflatable-body enclosure. Furthermore, it is possible for the desired flattening to be achieved regardless of the position of the interconnected sections of the inflatable-body enclosure and with particularly low outlay. If a plurality of pulling devices is used, it is, thus, possible to achieve a kind of folding-bellows effect. As a result, the inflatable-body enclosure expands specifically in one or two directions as it is inflated. The pulling devices may act on the inflatable-body enclosure at certain points and be disposed, for example, in grid form, it being possible for the pulling devices to be in the form of, for example, cords, rods, or chains, which may be connected to the inflatable-body enclosure, for example, by sewing or buttoning. The pulling devices and inflatable-body enclosure may also be connected by abutments that butt against the inflatable-body enclosure from the outside and are connected to the inner pulling devices. It is also possible, in general, for the pulling devices to be elastic.

In accordance with an added feature of the invention, the pulling devices may be, in particular, pulling strips made of flexible materials. These pulling strips may be fastened on the inflatable-body enclosure along lines. As a result, the tensile force exerted by them, rather than being applied at certain points, is distributed along a line. Furthermore, the pulling strips may be produced, in particular, from the same material as the inflatable-body enclosure. As a result, the pulling strips can usually be fastened relatively advantageously thereon. It is possible to use, both for the pulling strips and for the inflatable-body enclosure, in particular, a textile material that can be sewn.

In accordance with an additional feature of the invention, the inflatable body has an interior and at least one of the regions divided off by the pulling strips has only one inlet opening opening out into the interior of the inflatable body.

In accordance with yet another feature of the invention, it is possible, within an inflatable body with an at least partially gas-permeable enclosure and at least one inlet opening for a gaseous medium, to use the pulling strips to produce at least one region within the inflatable body with a reduced airflow. It is possible, here, to use the pulling strips to divide off pockets or channels such that the stream of the medium blown in, in particular, air, acts thereon to a lesser extent and/or a reduced airflow is produced in these regions. The pulling strips may also be disposed transversely to the airflow to obstruct the airflow into the divided-off regions and/or to direct it to a more pronounced extent into other regions of the inflatable body.

In accordance with yet a further feature of the invention, the inflatable body has an interior, at least one of the regions divided off by the pulling strips is closed, and an at least partially gas-permeable wall separates the at least one region from the interior of the inflatable body.

If heated air is used to inflate the inflatable body, in accordance with a concomitant feature of the invention, these regions can be used to achieve heat insulation at certain locations. This is advantageous, in particular, in the regions that tend to take on an unnecessarily high temperature. It is customary for the shirts, for pressing purposes, to be fitted in the damp state onto the inflatable body and to be pressed and dried by the heated air blown into the inflatable body. Uniform drying of the shirt as a whole is desired here because, otherwise, the prematurely dried regions are subjected unnecessarily to the action of heated air. As a result, unnecessary energy is used up. With the aid of the divided-off regions with reduced airflow, it is possible to provide heat insulation within the inflatable-body enclosure to achieve uniform drying of the shirt as a whole and, thus, to reduce the energy consumption. By virtue of regions that are divided off completely, it is possible to achieve a stationary air cushion with a particularly high degree of insulation.

Other features that are considered as characteristic for the invention are set forth in the appended claims.

Although the invention is illustrated and described herein as embodied in an apparatus for pressing shirts, having a partly flat inflatable body, it is, nevertheless, not intended to be limited to the details shown because various modifications and structural changes may be made therein without departing from the spirit of the invention and within the scope and range of equivalents of the claims.

The construction and method of operation of the invention, however, together with additional objects and advantages thereof, will be best understood from the following description of specific embodiments when read in connection with the accompanying drawings.

DESCRIPTION OF THE PREFERRED EMBODIMENTS

Figure 1:
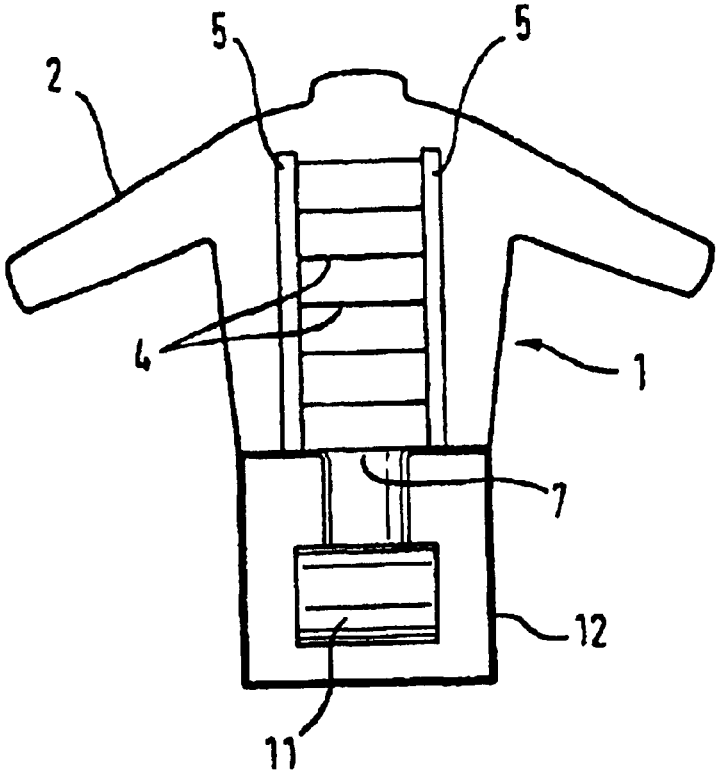
FIG. 1 is a vertical cross-sectional view from the front of a first embodiment of the shirt-pressing apparatus according to the invention.

Referring now to the figures of the drawings in detail and first, particularly to FIG. 1 thereof, there is shown a first embodiment of the shirt-pressing apparatus according to the invention having a bottom part 12 with an inflatable body 1 mounted thereon, a fan 11 with an integrated heater being accommodated within the bottom part 12 to make possible inflation of the inflatable body 1 by heated air. The shirt-forming inflatable body 1 has an enclosure 2 made of an air-permeable textile material.

Disposed in the interior of the inflatable-body enclosure 2 are longitudinal supports 5, which are fastened on the bottom part 12. The longitudinal supports 5 serve for fastening pulling strips 4, by which the chest and back regions of the inflatable-body enclosure 2 are to be retained in flat form.

Figure 2:
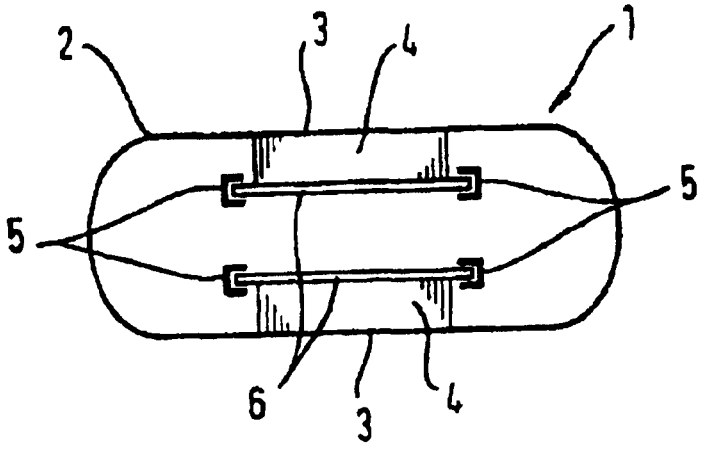
FIG. 2 is a horizontal cross-sectional view of the trunk section of the inflatable body of FIG. 1.

FIG. 2 illustrates the trunk of the inflatable body 1 in horizontal cross-section. The four longitudinal supports 5, which are disposed vertically within the inflatable-body enclosure 2, form, in twos in each case, guides for transverse rods 6, which are connected to the chest and back sections 3 of the inflatable-body enclosure 2 through the pulling strips 4. In the inflated state of the enclosure 2, the sections 3 are pulled inward by the pulling strips 4. As a result, the sections 3 remain flat even in the inflated state.

The transverse rods 6 can be displaced along the longitudinal supports 5. As a result, they can follow a movement of the enclosure 2 without such movement resulting in warping or deformation.

Figure 3:
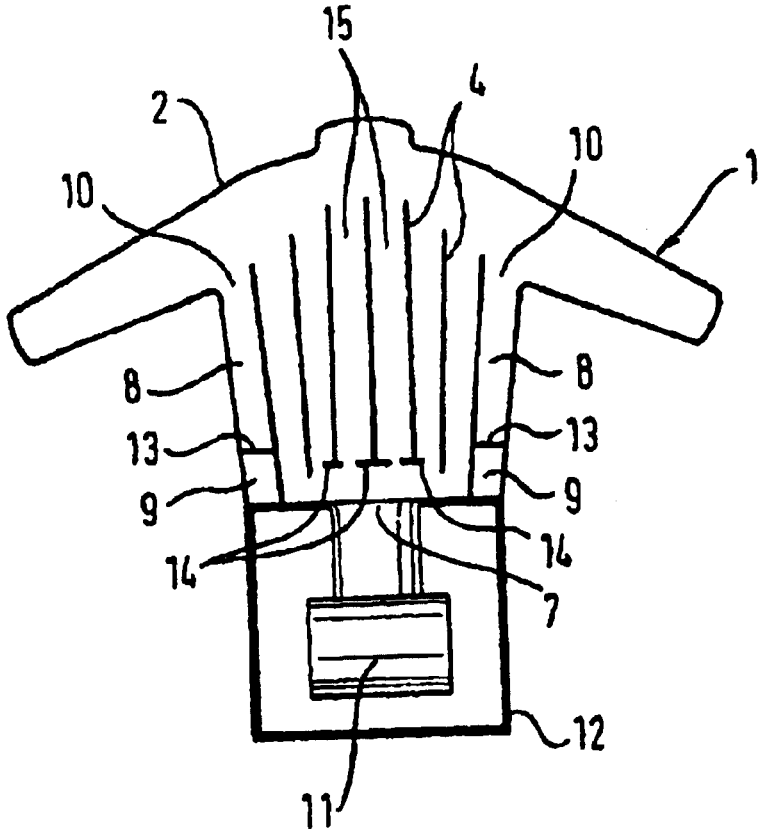
FIG. 3 is a vertical cross-sectional view from the front of a second embodiment of the shirt-pressing apparatus according to the invention.
Figure 4:
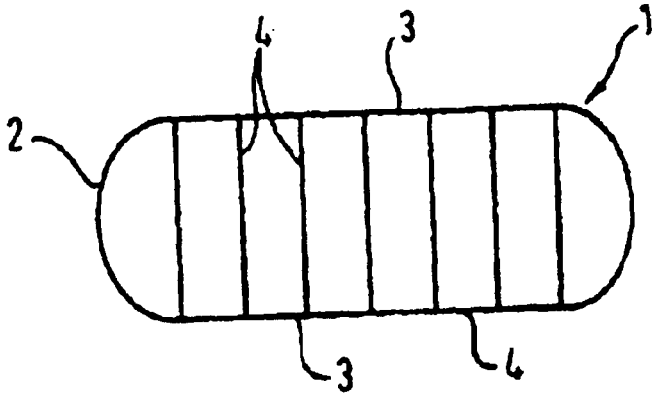
FIG. 4 is a horizontal cross-sectional view of the trunk section of the inflatable body of FIG. 3.

FIGS. 3 and 4 illustrate a second embodiment, in which the pulling strips 4, rather than being fastened on a fixed structure 5, connect mutually opposite sections of the inflatable-body enclosure 2 to one another in each case to achieve a flat cross-section. The pulling strips 4 in this case are disposed substantially vertically and extend substantially over the entire height of the trunk section of the inflatable-body enclosure 2. As such, the air that is blown in through the inlet opening 7 can flow vertically through the inflatable-body enclosure 2. The vertical configuration of the pulling strips 4 can achieve a planar form of the front and rear sides of the trunk of the inflatable body 1 that is not dependent on the trunk being constricted laterally by the shirt fitted thereon.

To prevent the inner region located directly above the inlet opening 7 from being heated to too pronounced an extent by the air stream that is blown in through the inlet opening 7, transverse strips 14 are disposed at the bottom ends of inner pulling strips 4. The transverse strips 14, thus, divide off channels 15 with a reduced cross-section at the bottom opening. The air is, thus, distributed uniformly over the channels formed by the pulling strips 4.

The outer pulling strips 4 are used, in addition, to divide off regions or chambers 8, 9, in which there is a reduced airflow, in order to reduce the temperature at these locations. For such a purpose, the outer pulling strips 4 are continued to the bottom, transverse strips 13 additionally being provided in the outer regions. This produces chambers 9 that have a substantially stationary air cushion and reduce the heat dissipation at this location. The chamber 9 is divided off from the interior of the inflatable-body enclosure 2 by air-permeable walls. For such a purpose, the transverse strips 13 or those sections of the pulling strips 4 that run in the regions of the chambers 9 may be air-permeable.

The chambers 8, which are located above the chambers 9 on the sides of the trunk section, are connected to the interior of the inflatable-body enclosure 2 only at their top end, through an inlet opening 10. As a result, in contrast to the other regions located between pulling strips 4, the chambers 8 have only very poor through flow, if any at all. The chambers 8 are supplied with warm air through the inlet opening 10 and can only discharge the same in the outward direction through the inflatable-body enclosure 2. As a result, here too, on account of the considerably lower level of airflow, there is a lower level of heat dissipation.

The configuration of the pulling strips 4, 13, 14 also makes it possible to set a higher level of heat dissipation specifically in individual regions to make allowances for regions of the shirt that are relatively slow to dry. This may be the case, for example, in regions in which the fabric is double-layered or inserts are sewn in or applications are sewn on.

In both embodiments, the pulling strips may be provided with openings for the airflow not to be obstructed.

We claim:

1. An apparatus for pressing shirts, comprising:

a shirt-form inflatable body having a flexible enclosure, said flexible enclosure having, in an inflated state of said body, at least one substantially flat section;

pulling devices spaced apart from one another and fastened to said flat section at sections within said inflatable body, said pulling devices each having an end, said pulling devices acting substantially perpendicularly on said flat section at which said pulling devices are fastened when said inflatable body is inflated, said sections of said inflatable-body enclosure at which said pulling devices are fastened being retained in a flat form by said pulling devices when said inflatable body is inflated; and a stiff structure disposed within said inflatable body and fastened to said end of said pulling devices.

2. The apparatus according to claim 1, wherein:

said pulling devices have a pulling direction;

fastening devices are transversely displaceable in said pulling direction; and said pulling devices are fastened on said stiff structure by said fastening devices.

3. The apparatus according to claim 1, wherein said pulling devices are pulling strips of a flexible material.

4. The apparatus according to claim 3, wherein:

said inflatable body has an at least partially gas-permeable enclosure and at least one inlet opening for a gaseous medium; and said pulling strips, at least in part, divide off regions within said inflatable body to reduce airflow into said regions.

5. The apparatus according to claim 4, wherein said pulling strips are disposed transversely to the airflow into said regions.

6. The apparatus according to claim 4, wherein:

said inflatable body has an interior; and at least one of said regions divided off by said pulling strips has only one inlet opening opening out into said interior of said inflatable body.

7. The apparatus according to claim 4, wherein:

said inflatable body has an interior;

at least one of said regions divided off by said pulling strips is closed; and an at least partially gas-permeable wall separates said at least one region from said interior of said inflatable body.

8. The apparatus according to claim 1, wherein said pulling devices are of an elastic material.

9. The apparatus according to claim 1, wherein:

said enclosure has an outside;

abutments are disposed on said outside and are connected to said pulling devices; and said pulling devices are fastened on said enclosure by said abutments.

10. An apparatus for pressing shirts, comprising:

a shirt-form inflatable body having a flexible enclosure, said flexible enclosure having, in an inflated state of said body, at least one substantially flat section;

spaced-apart pulling means fastened to said flat section at sections within said inflatable body, said pulling means having an end, said pulling means acting substantially perpendicularly on said flat section at which said pulling means are fastened when said inflatable body is inflated, said sections of said inflatable-body enclosure at which said pulling means are fastened being retained in a flat form by said pulling means when said inflatable body is inflated; and a stiff structure disposed within said inflatable body and fastened to said end of said pulling means.

11. The apparatus according to claim 10, wherein:

said pulling means have a pulling direction;

fastening devices are transversely displaceable in said pulling direction; and said pulling means are fastened on said stiff structure by said fastening devices.

12. The apparatus according to claim 10, wherein said pulling means are pulling strips of a flexible material.

13. The apparatus according to claim 12, wherein:

said inflatable body has an at least partially gas-permeable enclosure and at least one inlet opening for a gaseous medium; and said pulling strips, at least in part, divide off regions within said inflatable body to reduce airflow into said regions.

14. The apparatus according to claim 13, wherein said pulling strips are disposed transversely to the airflow into said regions.

15. The apparatus according to claim 13, wherein:

said inflatable body has an interior; and at least one of said regions divided off by said pulling strips has only one inlet opening opening out into said interior of said inflatable body.

16. The apparatus according to claim 13, wherein:

said inflatable body has an interior;

at least one of said regions divided off by said pulling strips is closed; and an at least partially gas-permeable wall separates said at least one region from said interior of said inflatable body.

17. The apparatus according to claim 10, wherein said pulling means are of an elastic material.

18. The apparatus according to claim 10, wherein:

said enclosure has an outside;

abutments are disposed on said outside and are connected to said pulling means; and said pulling means are fastened on said enclosure by said abutments.

* * * * *